US009873269B2

(12) United States Patent
Ishikawa et al.

(10) Patent No.: US 9,873,269 B2
(45) Date of Patent: Jan. 23, 2018

(54) PRINTER

(71) Applicant: FUJITSU COMPONENT LIMITED, Tokyo (JP)

(72) Inventors: Tetsuhiro Ishikawa, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/318,435

(22) PCT Filed: Jun. 19, 2015

(86) PCT No.: PCT/JP2015/067762
§ 371 (c)(1),
(2) Date: Dec. 13, 2016

(87) PCT Pub. No.: WO2015/198994
PCT Pub. Date: Dec. 30, 2015

(65) Prior Publication Data

US 2017/0120635 A1 May 4, 2017

(30) Foreign Application Priority Data

Jun. 24, 2014 (JP) ..... 2014-129556

(51) Int. Cl.
*B41J 11/70* (2006.01)

(52) U.S. Cl.
CPC ..... *B41J 11/70* (2013.01)

(58) Field of Classification Search
CPC ..... B41J 13/00; B41J 13/0009; B41J 15/00; B41J 11/68; B41J 11/70; B41J 15/046;
(Continued)

(56) References Cited

U.S. PATENT DOCUMENTS 6,428,226 B1 8/2002 Suzuki et al.
6,814,515 B2 11/2004 Tsuchiya et al.
(Continued)

FOREIGN PATENT DOCUMENTS

JP H11-123850 5/1999
JP 2003-019845 1/2003
(Continued)

*Primary Examiner* — Kristal Feggins
(74) *Attorney, Agent, or Firm* — IPUSA, PLLC

(57) ABSTRACT

A printer includes a print head configured to print on recording paper, a first roller, a cutter unit configured to cut the recording paper, and a presenter unit connected to the cutter unit and having a discharge slot from which the recording paper is discharged, wherein the recording paper on which the print head has printed enters the presenter unit through the cutter unit, and comes out from the discharge slot, and wherein the presenter unit includes a second roller configured to convey the recording paper, a flapper disposed along a transportation path of the recording paper between the second roller and the cutter unit and configured to be flipped open to outside the presenter unit to expose the transportation path, and a recording paper sensor disposed between the second roller and the discharge slot, wherein detection of the recording paper by the recording paper sensor causes the second roller to stop rotating, and causes the flapper to be flipped open to outside the presenter unit.

5 Claims, 12 Drawing Sheets

(58) Field of Classification Search
CPC . B41J 15/044; B41J 15/04; B41J 13/12; B41J 13/103; B41J 13/10
See application file for complete search history.

(56) References Cited

U.S. PATENT DOCUMENTS

| | | | |
|---|---|---|---|
| 2010/0054839 | A1 | 3/2010 | Sakai |
| 2014/0119805 | A1 | 5/2014 | Oguchi et al. |

FOREIGN PATENT DOCUMENTS

| | | |
|---|---|---|
| JP | 2003-170631 | 6/2003 |
| JP | 2006-044008 | 2/2006 |
| JP | 2010-047392 | 3/2010 |
| JP | 2014-091585 | 5/2014 |

PRINTER

TECHNICAL FIELD

The disclosures herein relate to a printer.

BACKGROUND ART

Printers for producing sales receipts or the like are widely used in cash registers used in stores, ATMs (automatic teller machines) or CDs (cash dispensers) installed in banks, etc. In a printer for producing sales receipts or the like, a thermal head or the like prints on thermal paper serving as recording paper while the recording paper is advanced. After the recording paper is advanced a predetermined length, a predetermined length of the recording paper is cut from the rest of the paper. A cutter has a fixed blade and a movable blade. The movable blade is moved toward the fixed blade to cut recording paper that is placed between the fixed blade and the movable blade.

Such a printer may be provided with a presenter connected thereto for the purpose of allowing a printed recording sheet to be removed by the user. The presenter has a recording sheet placed therein that is printed by a thermal head or the like and cut by a cutter. The recording sheet that is cut by the cutter to have a predetermined length has a portion thereof exposed from a discharge slot and placed in the presenter so that the sheet can be removed by the user. Upon the recording sheet being removed by the user, the print operation by the printer comes to completion. If a predetermined time length passes without the recording sheet being removed by the user, the printed recording sheet is retracted into the presenter.

RELATED-ART DOCUMENTS

Patent Document

[Patent Document 1] Japanese Patent Application Publication No. 2003-19845

SUMMARY OF THE INVENTION

Problem to be Solved by the Invention

As may be noted, a printer such as a thermal printer utilizes a roll of recording paper. When the recording paper has strong curl or has a thin thickness, and is long, the recording paper may end up being folded or jammed in the presenter.

Accordingly, it may be desired to provide a printer having a presenter in which a recording sheet is neither folded nor jammed.

Means to Solve the Problem

According to one aspect of the embodiment, a printer includes a print head configured to print on recording paper, a first roller, a cutter unit configured to cut the recording paper, and a presenter unit connected to the cutter unit and having a discharge slot from which the recording paper is discharged, wherein the recording paper on which the print head has printed enters the presenter unit through the cutter unit, and comes out from the discharge slot, and wherein the presenter unit includes a second roller configured to convey the recording paper, a flapper disposed along a transportation path of the recording paper between the second roller and the cutter unit and configured to be flipped open to outside the presenter unit to expose the transportation path, and a recording paper sensor disposed between the second roller and the discharge slot, wherein detection of the recording paper by the recording paper sensor causes the second roller to stop rotating, and causes the flapper to be flipped open to outside the presenter unit.

Advantage of the Invention

According to at least one embodiment, a printer having a presenter is provided in which a recording sheet is neither folded nor jammed.

MODE FOR CARRYING OUT THE INVENTION

In the following, embodiments for implementing the invention will be described. The same members or the like are referred to by the same numerals, and a description thereof will be omitted.

Figure 1:
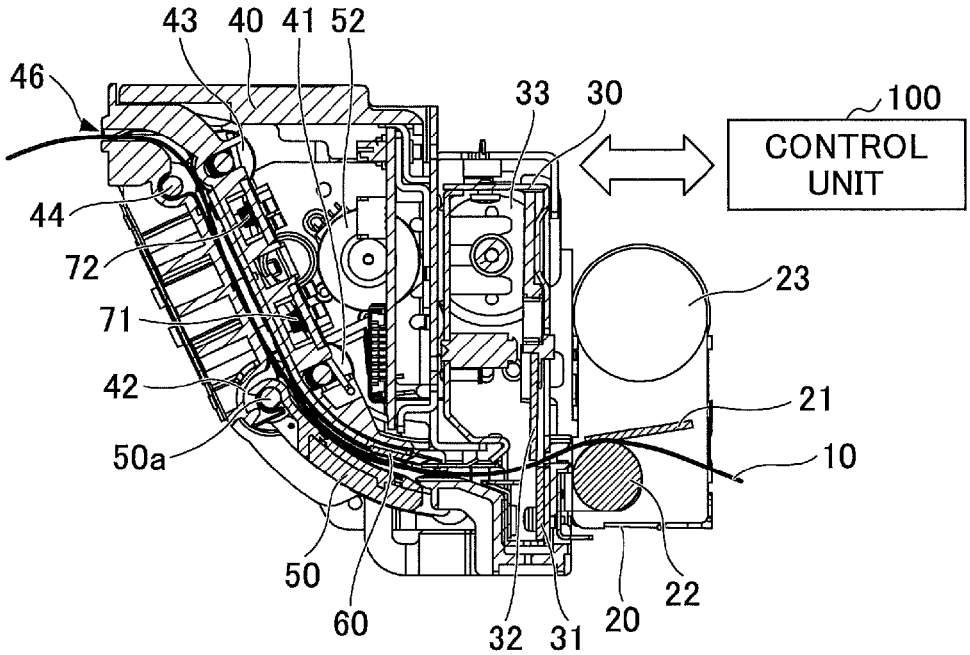
FIG. 1 is a drawing illustrating the structure of the printer according to the present embodiment.
Figure 2:
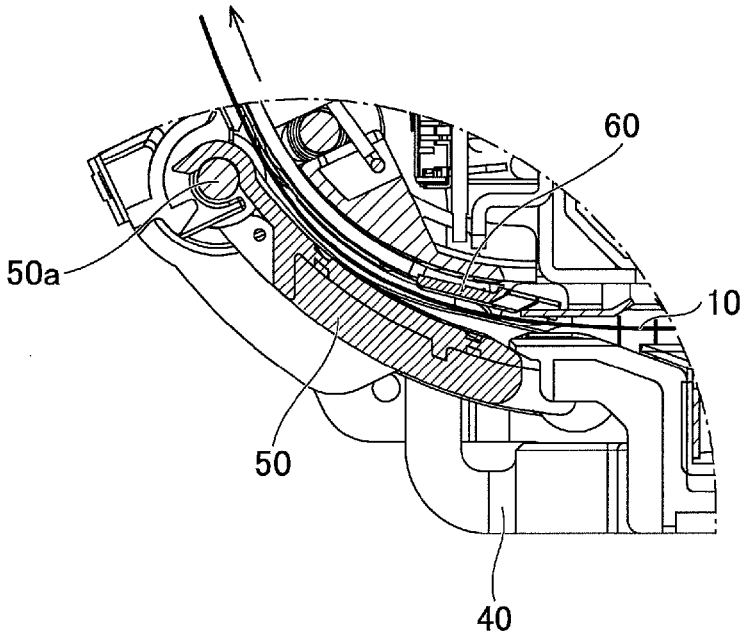
FIG. 2 is an enlarged view of a main part of the printer according to the present embodiment.
Figure 3:
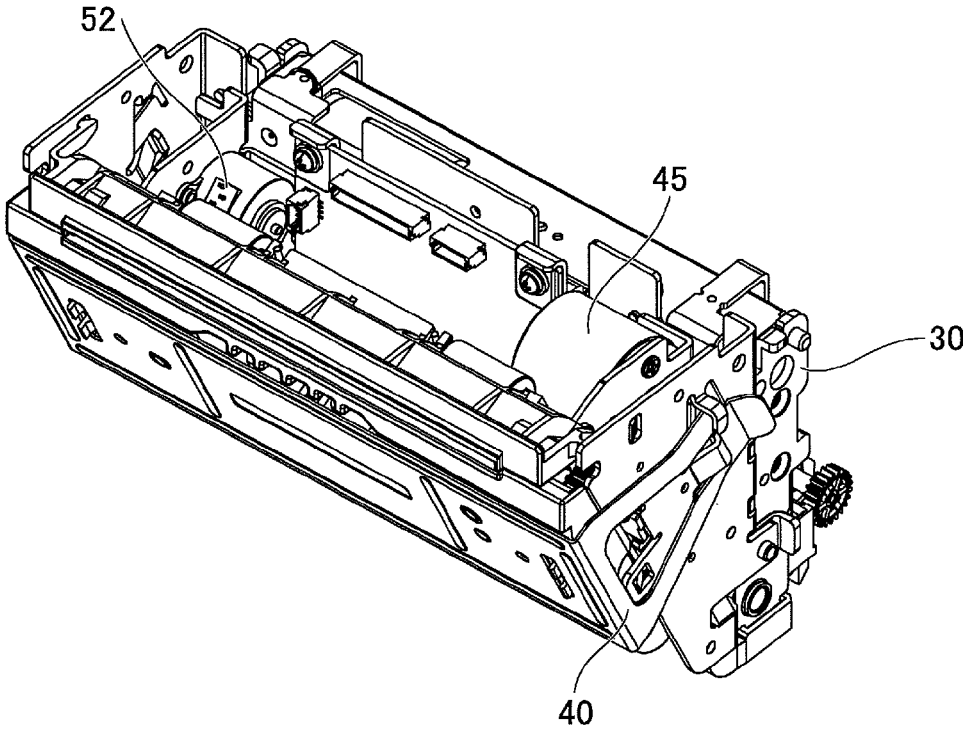
FIG. 3 is an axonometric view of the printer according to the present embodiment.
Figure 4:
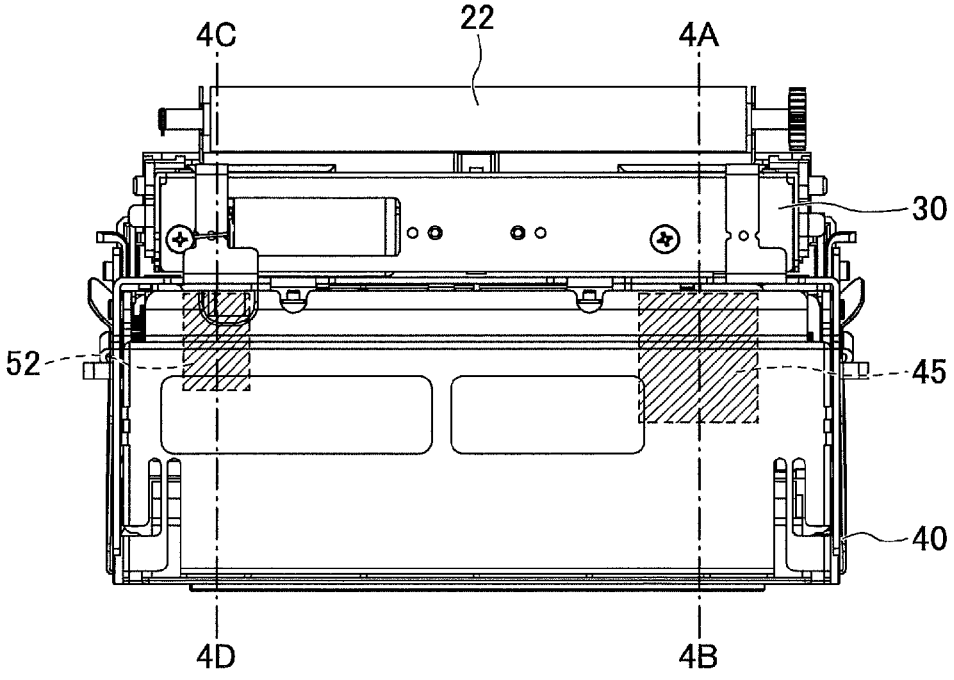
FIG. 4 is a top view of the printer according to the present embodiment.
Figure 5:
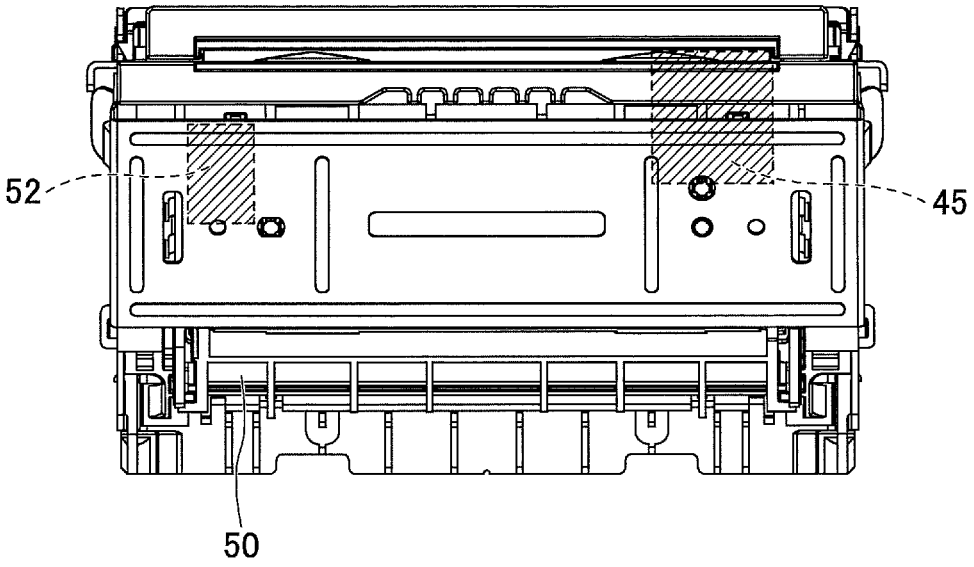
FIG. 5 is a front view of the printer according to the present embodiment.
Figure 6:
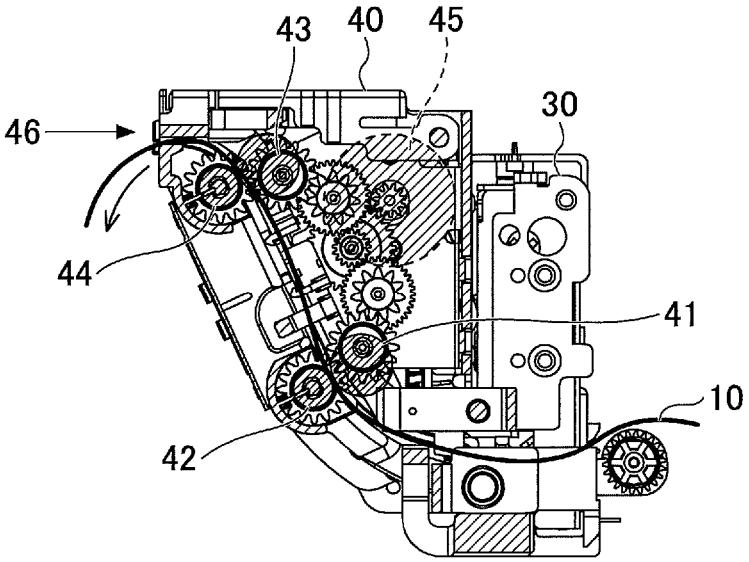
FIG. 6 is a cross-sectional view of the printer according to the present embodiment.
Figure 7:
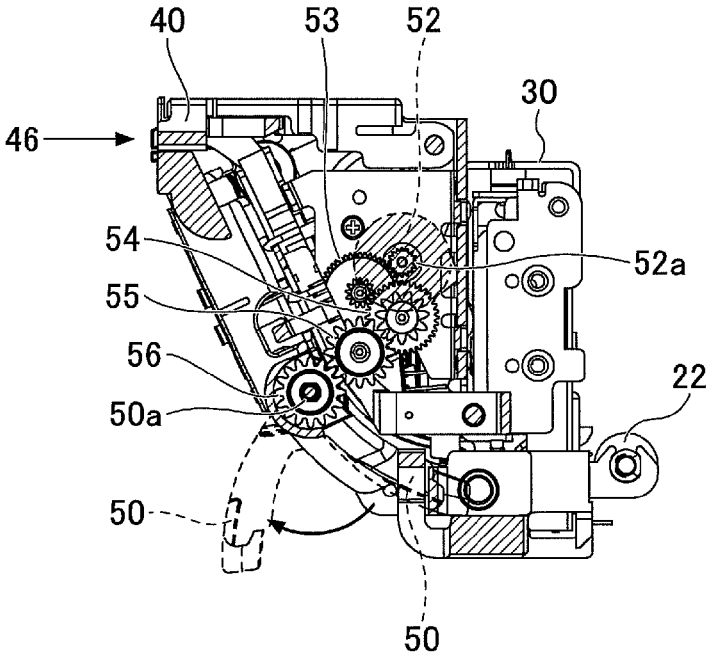
FIG. 7 is a cross-sectional view of the printer according to the present embodiment.

A printer according to the present embodiment will be described with reference to FIGS. 1 through 7. FIG. 1 is a schematic view illustrating the structure of the printer according to the present embodiment. FIG. 2 is an enlarged view of a main portion of the printer illustrated in FIG. 1. FIG. 3 is an axonometric view of the printer. FIG. 4 is a top view of the printer. FIG. 5 is a front view of the printer. FIG. 6 is a cross-sectional view of the printer taken along the doted and dashed line 4A-4B in FIG. 4. FIG. 7 is a cross-sectional view of the printer taken along the doted and dashed line 4C-4D in FIG. 4. FIG. 1, FIG. 2, and FIG. 6 illustrate recording paper 10 for the purpose of providing a clear view of a transport path of the recording paper 10.

The printer of the present embodiment prints on the recording paper 10 from a paper roll. The printer includes a printer main body 20, a cutter unit 30, and a presenter unit 40. In the present embodiment, the printer main body 20 and the cutter unit 30 are connected to each other, and the cutter unit 30 and the presenter unit 40 are connected to each other.

The printer main body 20 includes a thermal head 21 serving as a print head for printing on the recording paper 10, a platen roller 22, and a transport motor 23 for conveying the recording paper 10. The recording paper 10 is fed into the printer main body 20 through a transport slot that is not illustrated. The cutter unit 30 includes a fixed blade 31, a movable blade 32, a movable-blade motor for driving the movable blade 32, and gears and the like (not shown) for transmitting the driving force generated by the rotation of the movable-blade motor 33 to the movable blade 32.

In the printer main body 20, the transport motor 23 rotates the platen roller 22 while the recording paper 10 is placed between the thermal head 21 and the platen roller 22, thereby conveying the recording paper 10. The thermal head 21 prints on the recording paper 10 being conveyed by the rotation of the platen roller 22.

The printed recording paper 10 is then cut by the cutter unit 30. Specifically, upon the recording paper 10 being moved to a predetermined location, the movable-blade motor 33 rotates to drive the movable blade 32 and to move the movable blade 32 toward the fixed blade 31, thereby cutting the recording paper 10 between the fixed blade 31 and the movable blade 32.

The presenter unit 40 includes a first roller 41, a second roller 42, a third roller 43, a fourth roller 44, a transport roller 45, a flapper 50, and a recording paper transport guide 60, which are provided for the purpose of conveying printed recording paper. The first roller 41 and the second roller 42 are disposed to face each other, and the third roller 43 and the fourth roller 44 are disposed to face each other. Both the second roller and the fourth roller 44 are rotated through gears (not shown) by the rotating transport roller 45, resulting in the first roller 41 rotating by following the rotation of the second roller 42, and the third roller 43 rotating by following the rotation of the fourth roller 44. With this arrangement, the recording paper 10 placed between the first roller 41 and the second roller 42 and placed between the third roller 43 and the fourth roller 44 is conveyed inside the presenter unit 40. The recording paper 10 conveyed in the presenter unit 40 is exposed from a discharge slot 46. The user pulls out the exposed portion from the discharge slot 46 to remove the recording paper 10.

The length of the recording paper 10 upon being cut is dependent on the usage thereof, so that the position at which the recording paper 10 is cut also varies. Since the length of the transport path of the recording paper 10 inside the presenter unit 40 is a fixed length, the recording paper 10 is cut after creating a slack in the recording paper 10 in the case in which a longer length of the recording paper 10 than the length of the transport path needs to be cut. In the present embodiment, as illustrated by dotted lines in FIG. 7, the flapper 50 of the presenter unit 40 is flipped open to outside the presenter unit 40 in the direction illustrated by an arrow, thereby providing a slack in the printed recording paper 10 extending to outside the presenter unit 40. With this arrangement, the recording paper 10 can be cut to have a desired length even if the length of the recording paper 10 to be discharged is longer than the length of the transport path of the recording paper 10 inside the presenter unit 40.

The flapper 50 is connected to the presenter unit 40 such as to be rotatable around a rotation axis 50*a*. A flapper drive motor 52 disposed inside the presenter unit 40 rotates to flip open and close the flapper 50. Specifically, a first gear 53, a second gear 54, a third gear 55, and a fourth gear 56 are provided in the presenter unit 40. The first gear 53 is connected to a gear 52*a* of the flapper drive motor 52. Accordingly, rotation of the flapper drive motor 52 causes the gear 52*a* of the flapper drive motor 52, the first gear 53, the second gear 54, the third gear 55, and the fourth gear 56 to rotate, thereby causing the flapper 50 to rotate around the rotation axis 50*a* to flip open.

However, the recording paper 10 used in the printer of the present embodiment may be from a roll of recording paper, so that the recording paper 10 has curl. The use of such curled recording paper 10, especially the use of strongly curled recording paper 10, may give rise to a situation in which the opened flapper 50 fails to create a sufficient slack in the recording paper 10, resulting in the recording paper 10 being folded or jammed. The same applies in the case of the recording paper 10 that is thin.

In the printer of the present embodiment, as illustrated in FIG. 2, for example, the recording paper transport guide 60 is provided in the presenter unit 40. When the flapper 50 of the presenter unit 40 is closed, the recording paper transport guide 60 is situated deeper inside the presenter unit 40 than is the flapper 50, and is supported by the flapper 50. The recording paper transport guide 60 is situated further toward the inside than the transport path of the recording paper 10, and faces the flapper 50 across the transport path of the recording paper 10. Namely, the recording paper transport guide 60 is situated further toward the inside than the transport path of the recording paper 10, and the flapper 50 is situated further toward the outside than the transport path of the recording paper 10. The support by the flapper 50 is removed as the flapper 50 opens, resulting in the recording paper transport guide 60 being also flipped outward (i.e., moving toward the outside). When the flapper 50 is closed and the recording paper 10 is situated in the transport path between the flapper 50 and the recording paper transport guide 60, the recording paper transport guide 60 is supported by the flapper 50 via the recording paper 10.

In the present embodiment, a first recording paper sensor 71 and a second recording paper sensor 72 are provided between the first roller 41 and the third roller 43 in order to detect whether the recording paper 10 is present in the transport path between the first roller 41 and the third roller 43. The first recording paper sensor 71 and the second recording paper sensor 72 may be reflective-type optical sensors, for example. In the present embodiment, the first recording paper sensor is situated further toward the first roller 41 than is the second recording paper sensor 72. Accordingly, the printed recording paper 10 being conveyed along the transport path inside the presenter unit 40 is first detected by the first recording paper sensor 71, and is then detected by the second recording paper sensor 72 upon further travel.

Figure 8:
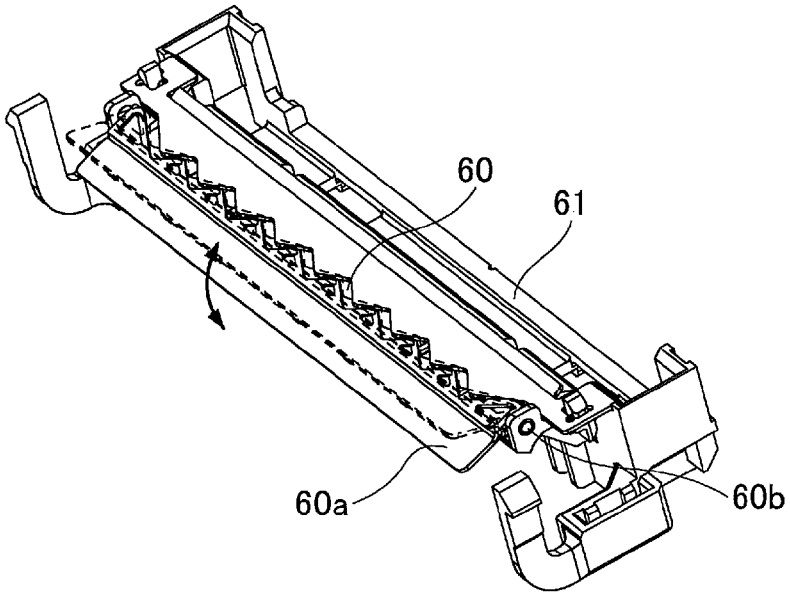
FIG. 8 is an axonometric view of a recording paper transport guide of the printer according to the present embodiment.

The recording paper transport guide 60 may be flipped to outside due to its own weight. Alternatively, a member exerting a restorative force such as a spring may be provided, and the recording paper transport guide 60 may be flipped to outside by the restorative force of the spring or the like. As illustrated in FIG. 8, the recording paper transport guide 60 is connected in a rotatable manner to a mount member 61, which is provided to attach the recording paper transport guide 60 to the presenter unit 40. Specifically, the recording paper transport guide 60 has a guide unit 60*a* for guiding the recording paper 10, and rotates around a rotation axis 60*b* provided for the recording paper transport guide 60 so that the direction of the guide unit 60*a* changes downward as illustrated in FIG. 8. With this arrangement, the recording paper transport guide 60 is flipped outward (i.e., moves toward the outside) to intrude into the transport path, thereby being able to change the transport direction of the recording paper 10 toward the outside of the presenter unit 40.

At the time of flipping open the flapper 50, the timing of the flipping of the flapper 50 may cause the printed recording paper 10 to be folded between the cutter unit 30 and the presenter unit 40, which may jam the recording paper 10 along the transport path. Namely, the failure to flip open the flapper 50 at desired timing causes the printed recording paper 10 to be folded and jammed. This is especially frequently observed when the recording paper 10 is thin, soft paper with small stiffness.

In the following, a description will be given of the opening and closing of the flapper 50 in the presenter unit 40 of the printer of the present embodiment. The printer of the present embodiment stops the rotation of the second roller 42 and flips open the flapper 50 in response to the detection of the recording paper 10 by the first recording paper sensor 71. The operation of the printer of the present embodiment is performed under the control of a control unit 100 provided in the printer of the present embodiment.

Figure 9A:
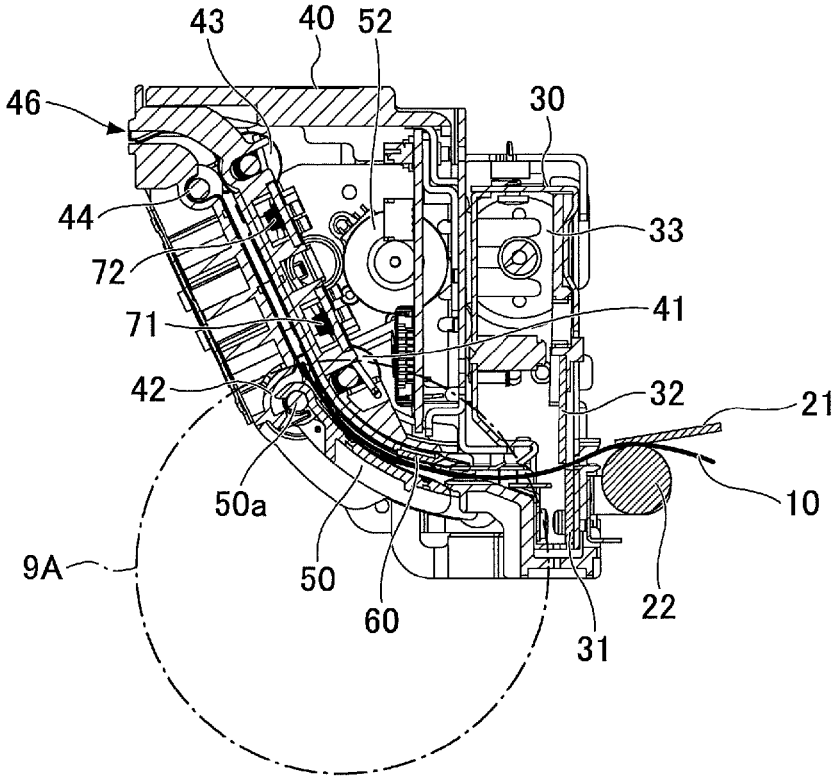
FIG. 9A is a drawing illustrating the opening and closing of the flapper of the printer according to the present embodiment.
Figure 9B:
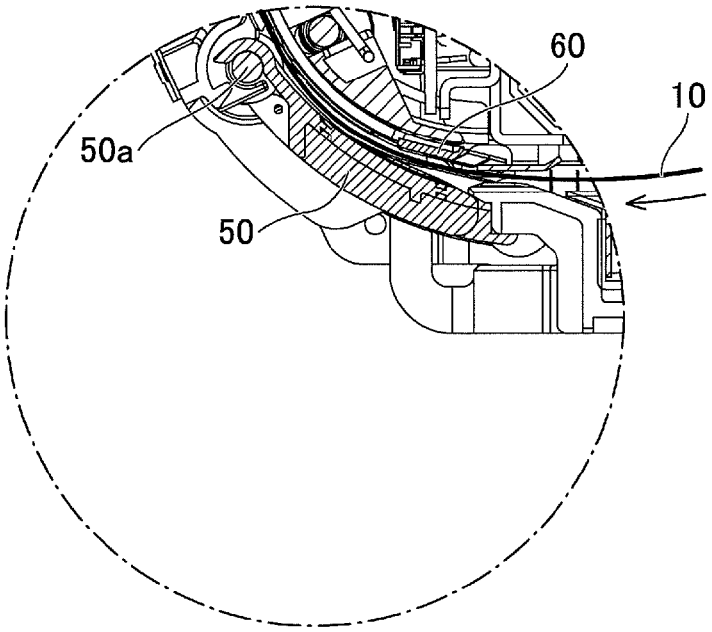
FIG. 9B is a drawing illustrating the opening and closing of the flapper of the printer according to the present embodiment.

As illustrated in FIGS. 9A and 9B, the recording paper 10 on which the thermal head 21 has printed passes through the cutter unit 30 first, and then enters the transport path situated inside the presenter unit 40. As this happens, the recording paper 10 is conveyed while placed between the first roller 41 and the second roller 42 inside the presenter unit 40. In this state, the flapper 50 is closed, so that the recording paper transport guide 60 is placed in its original position. The flapper 50 is situated under the transport path of the recording paper 10, and the recording paper transport guide 60 is situated over the transport path of the recording paper 10. The recording paper 10 thus passes through the transport path between the flapper 50 and the recording paper transport guide 60. In FIG. 9A, the first recording paper sensor 71 disposed between the first roller 41 and the third roller 43 has not yet detected the recording paper 10, so that the flapper 50 remains to be closed, and the first roller 41 and the second roller 42 are rotating. FIG. 93 is an enlarged view of a portion enclosed by a dotted and dashed line 9A in FIG. 9A.

Figure 10A:
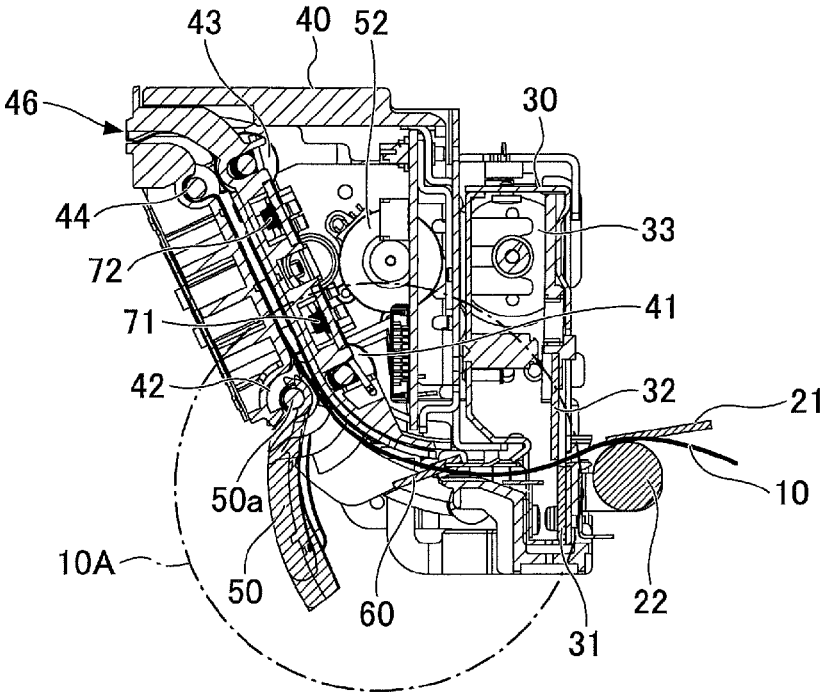
FIG. 10A is a drawing illustrating the opening and closing of the flapper of the printer according to the present embodiment.
Figure 10B:
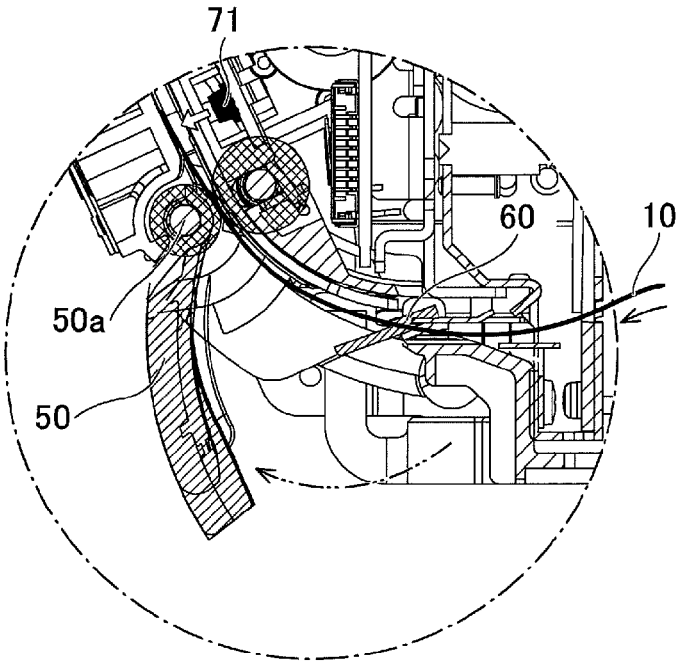
FIG. 10B is a drawing illustrating the opening and closing of the flapper of the printer according to the present embodiment.

Subsequently, the printed recording paper 10 is further conveyed by the first roller 41 and the second roller 42 from the state illustrated in FIGS. 9A and 9B to the state as illustrated in FIGS. 10A and 10B, in which the recording paper 10 has advanced to the position at which the first recording paper sensor 71 is disposed. The first recording paper sensor 71 thus detects the recording paper 10. As the first recording paper sensor 71 detects the recording paper 10 as described above, the control unit 100 (see FIG. 1) stops the rotation of the second roller 42, thereby suspending the travel of the recording paper 10 in the transport path beyond the point of the second roller 42 in the presenter unit 40, and flipping open the flapper 50. The flapper 50 being flipped open toward the outside of the presenter unit 40 causes the transport path to be exposed to the outside of the presenter unit 40. In this state, the portion of the printed recording paper 10 close to its head end is placed between, and gripped by, the first roller 41 and the second roller 42. FIG. 103 is an enlarged view of a portion enclosed by a dotted and dashed line 10A in FIG. 10A.

Figure 11A:
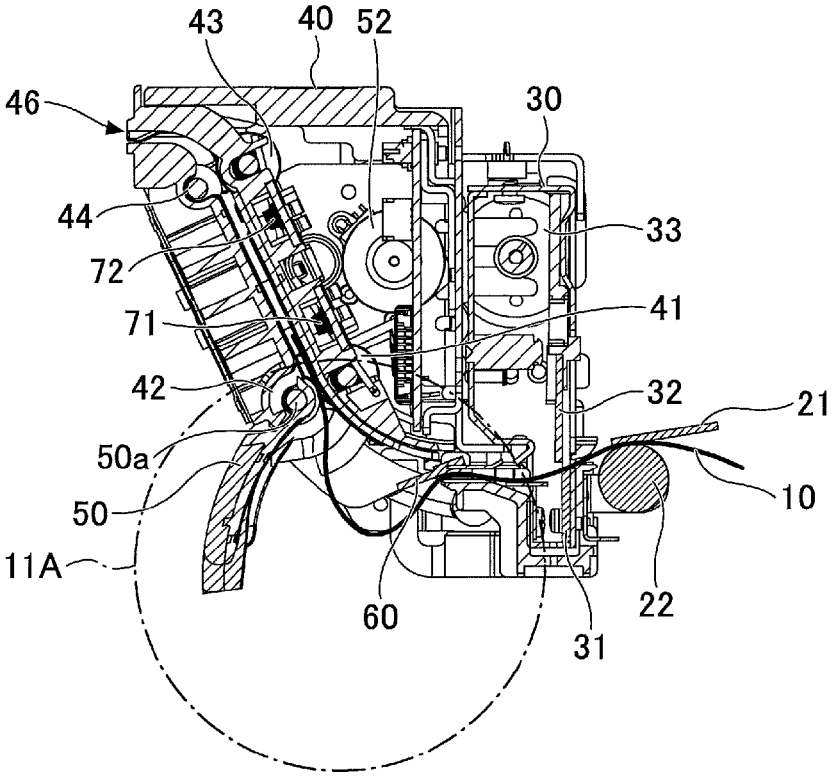
FIG. 11A is a drawing illustrating the opening and closing of the flapper of the printer according to the present embodiment.
Figure 11B:
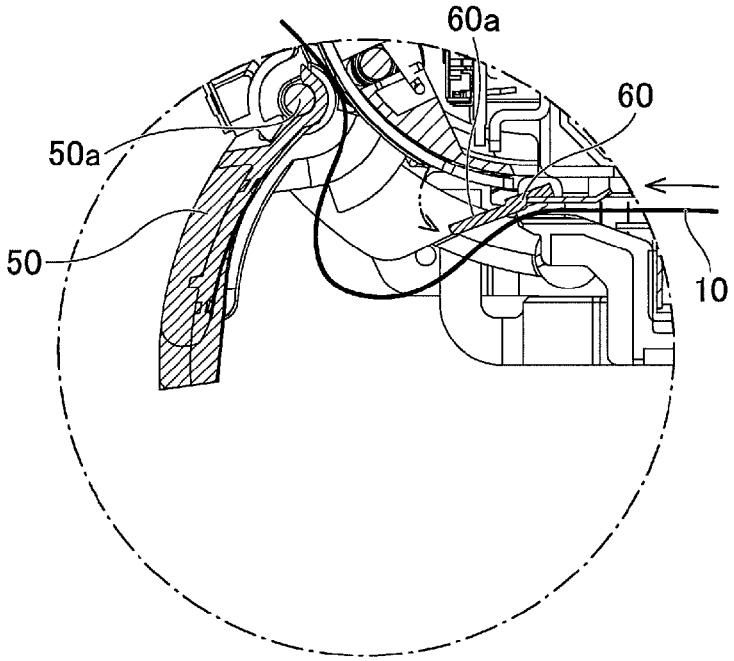
FIG. 11B is a drawing illustrating the opening and closing of the flapper of the printer according to the present embodiment.

Subsequently, as illustrated in FIGS. 11A and 11B, the rotation of the second roller 42 is stopped. While the flapper 50 is in the open state, the recording paper 10 printed by the thermal head 21 is conveyed by the platen roller into the presenter unit 40 after passing through the cutter unit 30 Namely, the rotation of the platen roller 22 causes the printed recording paper 10 to be conveyed toward the presenter unit 40. Since the first roller and the like are not rotating, the recording paper 10 will produce a slack that extends to outside the presenter unit 40 through the space provided by the opened flapper 50. FIG. 11B is an enlarged view of a portion enclosed by a dotted and dashed line 11A in FIG. 11A.

In the present embodiment, the flapper 50 of the presenter unit 40 is flipped open, and, together therewith, the recording paper transport guide 60 is flipped outward, so that the guide unit 60*a* of the recording paper transport guide 60 is directed downward (i.e., moves outwardly to intrude into the transport path). As a result, the downwardly directed guide unit 60*a* guides the recording paper 10 such that the travel direction of the recording paper 10 is directed to outside the presenter unit 40. This creates a desired slack in the recording paper 10 without causing the recording paper 10 to be folded despite the presence of strong curl in the recording paper 10.

Figure 12A:
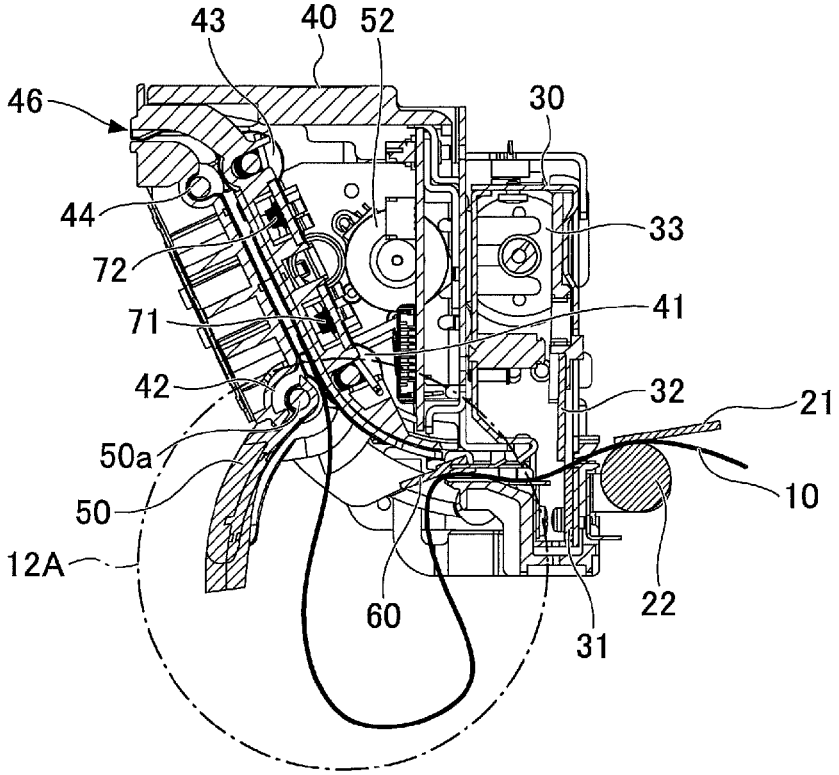
FIG. 12A is a drawing illustrating the opening and closing of the flapper of the printer according to the present embodiment.
Figure 12B:
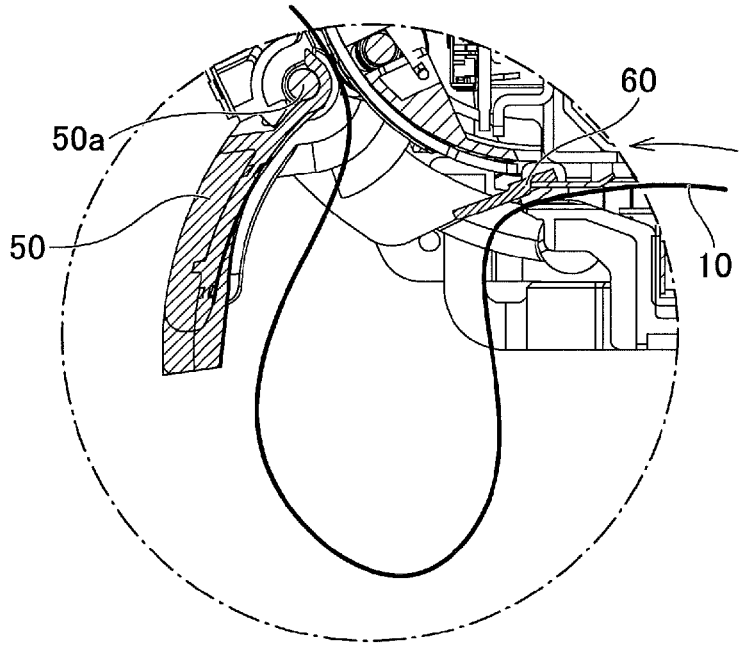
FIG. 12B is a drawing illustrating the opening and closing of the flapper of the printer according to the present embodiment.

Subsequently, as illustrated in FIGS. 12A and 12B, the rotation of the second roller 42 is stopped. While the flapper 50 is in the open state, the recording paper 10 printed by the thermal head 21 is conveyed by the platen roller 22 to proceed further into the presenter unit 40 after passing through the cutter unit 30. Namely, the rotation of the platen roller 22 causes the printed recording paper 10 to be further conveyed toward the presenter unit 40. In this state, the second roller 42 and the like are not rotating, and the flapper 50 is open, so that the recording paper 10 printed by the thermal head 21 travels toward the outside of the presenter unit 40 due the open-position flapper 50 after passing through the inside of the cutter unit 30. As a result, the slack of the recording paper 10 extending to the outside of the presenter unit 40 grows. FIG. 123 is an enlarged view of a portion enclosed by a dotted and dashed line 12A in FIG. 12A.

Figure 13A:
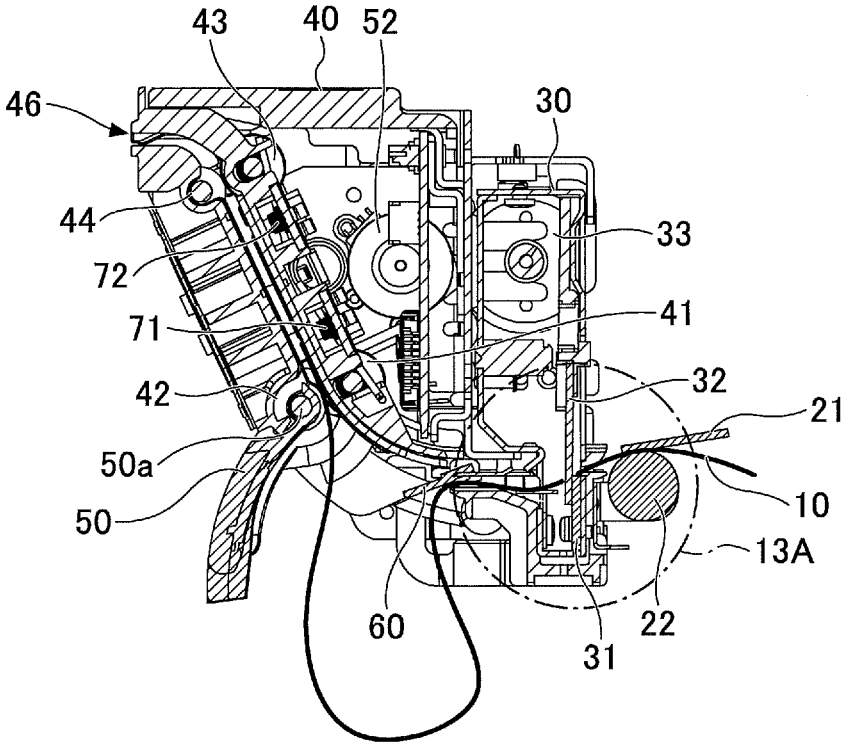
FIG. 13A is a drawing illustrating the opening and closing of the flapper of the printer according to the present embodiment.
Figure 13B:
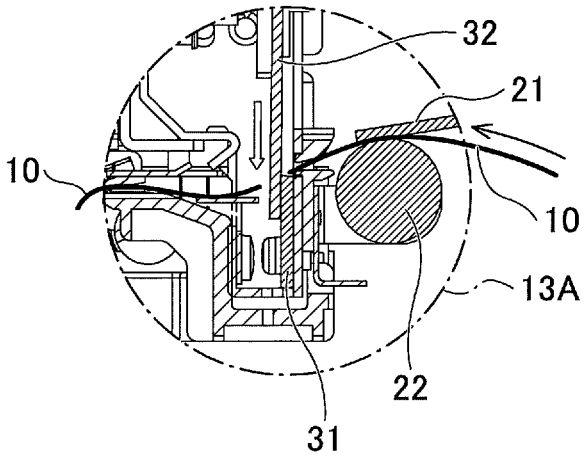
FIG. 13B is a drawing illustrating the opening and closing of the flapper of the printer according to the present embodiment.

Subsequently, as illustrated in FIGS. 13A and 13B, the cutter unit 30 uses the fixed blade 31 and the movable blade 32 to cut a desired length of the printed recording paper 10. A portion of the printed recording paper 10 extends to outside the presenter unit 40 through the space provided by the open flapper 50, which makes it possible for a desired length of the recording paper 10 to be cut even when such a desired length is longer than the length of the transport path. FIG. 13B is an enlarged view of a portion enclosed by a dotted and dashed line 13A in FIG. 13A.

Figure 14:
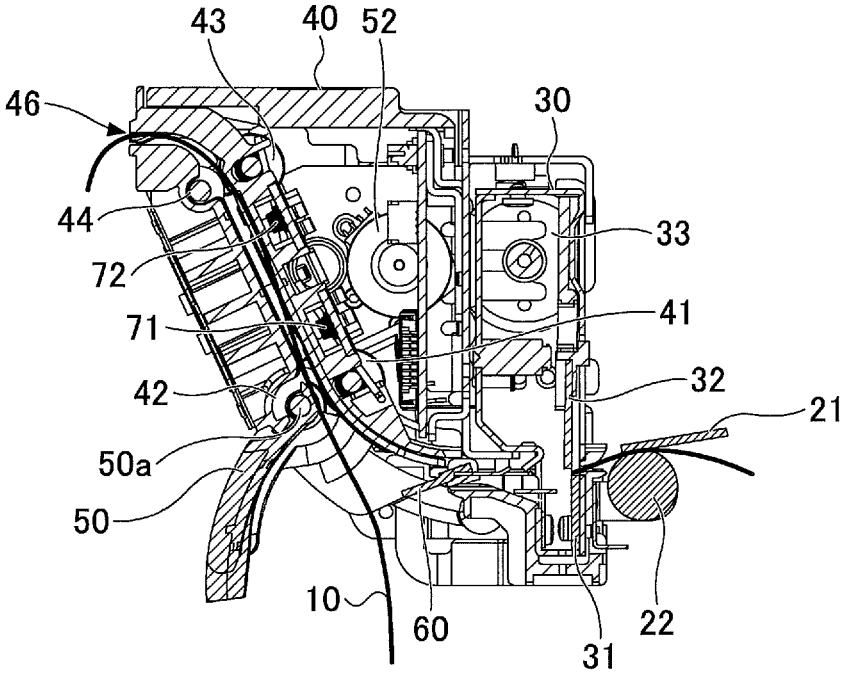
FIG. 14 is a drawing illustrating the opening and closing of the flapper of the printer according to the present embodiment.
Figure 15A:
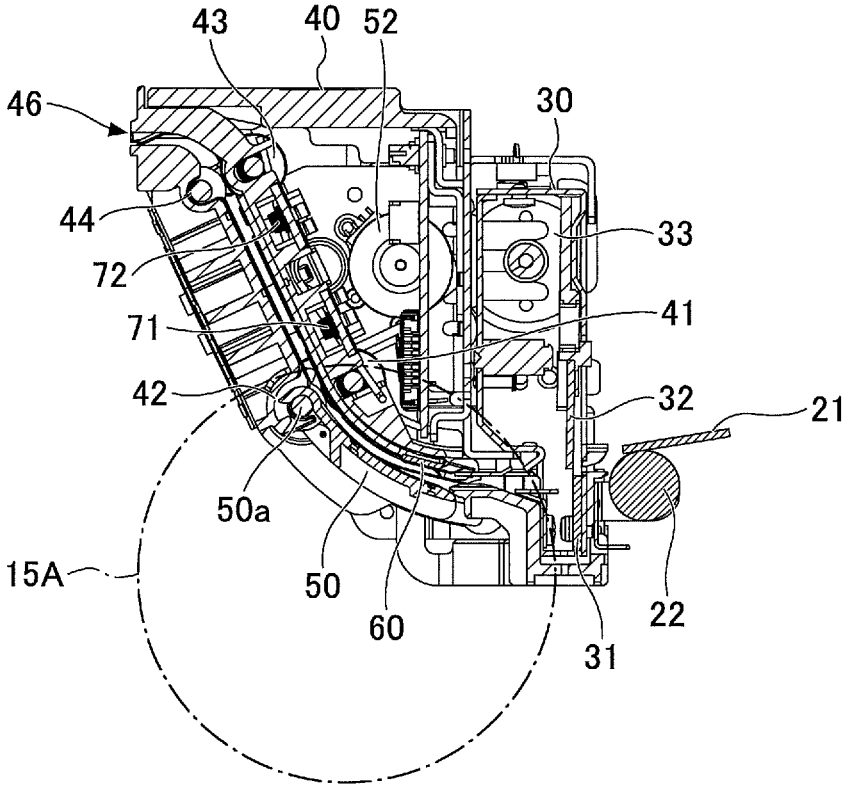
FIG. 15A is a drawing illustrating the opening and closing of the flapper of the printer according to the present embodiment.
Figure 15B:
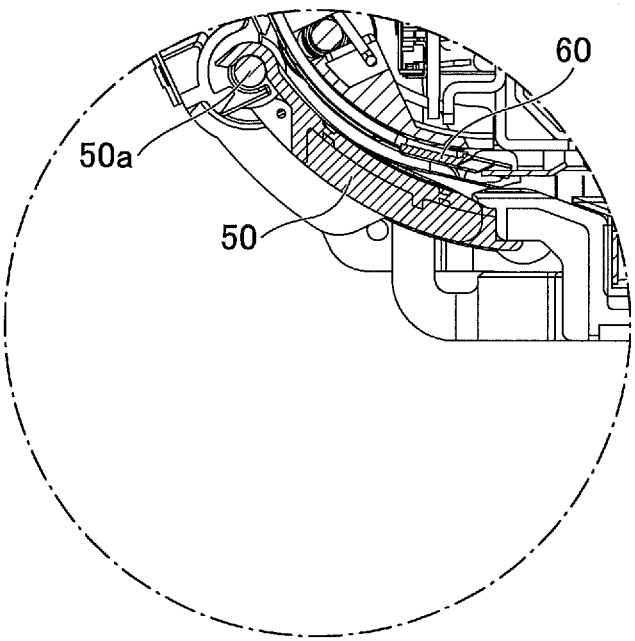
FIG. 15B is a drawing illustrating the opening and closing of the flapper of the printer according to the present embodiment.

After this, as illustrated in FIG. 14, the rotation of the second roller 42 and the fourth roller 44 causes the head end of the printed recording paper 10 to be conveyed to the discharge slot 46 and thus to be placed in the state in which a user can pull out the recording paper 10 from the discharge slot 46. In such a state in which the recording paper 10 is exposed from the discharge slot 46, the user pulls out the recording paper 10 to remove the recording paper 10 from the discharge slot 46. After the printed recording paper 10 is removed by the user, the flapper drive motor 52 rotates in a reverse direction to close the flapper 50 and, in conjunction therewith, to return the recording paper transport guide 60 to the closed position as illustrated in FIGS. 15A and 15B. Reverse rotation of the flapper drive motor 52 at this instant is performed after the first recording paper sensor 71 and the second recording paper sensor 72 confirm the nonexistence of the recording paper 10 in the transport path, i.e., confirm the removal of the recording paper 10 from the transport path. FIG. 15B is an enlarged view of a portion enclosed by a dotted and dashed line 15A in FIG. 15A.

Figure 16:
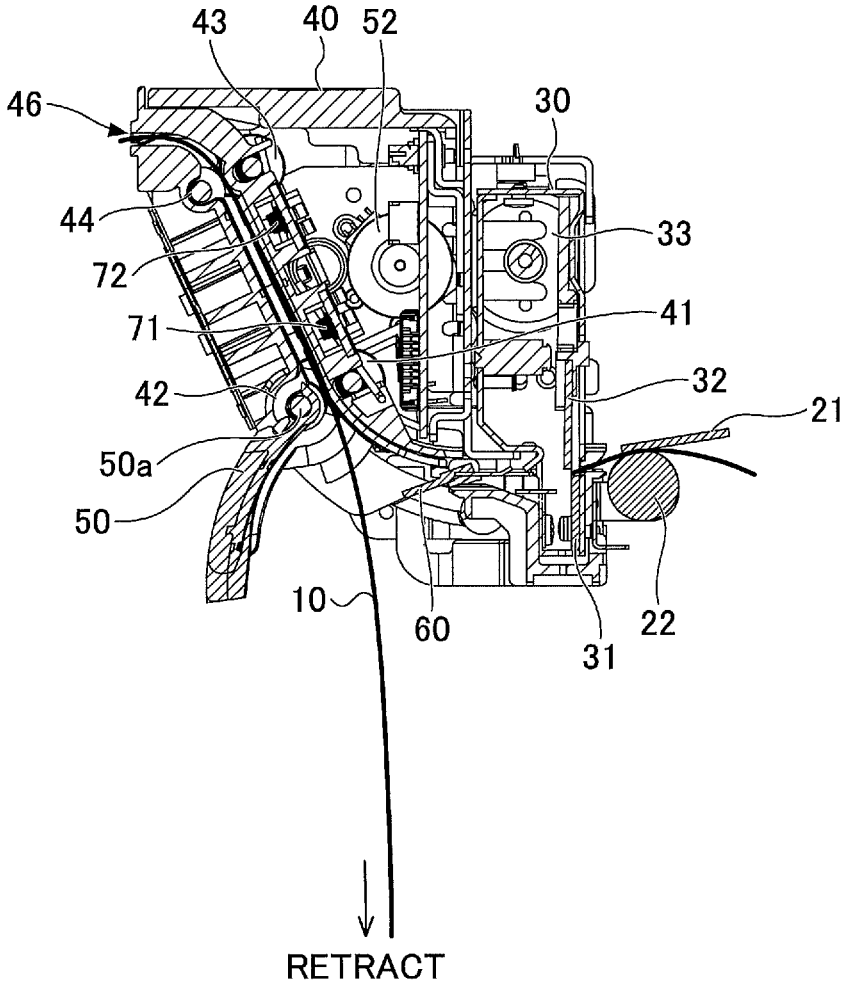
FIG. 16 is a drawing illustrating the opening and closing of the flapper of the printer according to the present embodiment.

There may be a case in which the recording paper 10 having a portion thereof exposed from the discharge slot 46 is not removed by a user even after the passage of a predetermined time following the cutting of the recording paper 10. In such a case, the printed recording paper 10 is retracted as illustrated in FIG. 16. This is done for the purpose of preventing the printed recording paper 10 from being taken by an unintended user. The retraction of the recording paper 10 is performed by the reverse rotation of the transport roller 45 which causes the first roller 41 and the third roller 43 to be rotated in the reverse direction to convey the recording paper 10 in the reverse direction through the transport path. The recording paper 10 that has been conveyed in the reverse direction through the transport path in the presenter unit 40 in this manner is discharged to outside the presenter unit 40 through the space provided by the open flapper 50. Thereafter, as illustrated in FIGS. 15A and 15B, the flapper drive motor 52 rotates in the reverse direction to close the flapper 50 as well as to return the recording paper transport guide 60 to the closed position.

When next printing is performed on the recording paper 10, the same or similar operations as described heretofore will be performed.

Further, although a description has been given with respect to one or more embodiments of the present invention, the contents of such a description do not limit the scope of the invention. For example, although the first recording paper sensor 71 and the second recording paper sensor 72 are used in the one or more embodiments heretofore described, a single sensor may solely be used, or three or more sensors may be used.

The present application claims foreign priority to Japanese priority application No. 2014-129556 filed on Jun. 24, 2014, with the Japanese Patent Office, the entire contents of which are hereby incorporated by reference.

DESCRIPTION OF REFERENCE SYMBOLS

10 recording paper
20 printer main body
21 thermal head
22 platen roller
23 conveyance motor
30 cutter unit
31 fixed blade
32 movable blade
33 movable-blade motor
40 presenter unit
41 first roller
42 second roller
43 third roller
44 fourth roller
45 conveyance motor
46 discharge slot
50 flapper
50*a* rotation axis
52 flapper drive motor
52*a* gear
53 first gear
54 second gear
55 third gear
56 fourth gear
60 recording paper transport guide
60*a* guide unit
60*b* rotation axis
61 mounting member
71 first recording paper sensor
72 second recording paper sensor

The invention claimed is:

1. A printer, comprising:

a print head configured to print on recording paper;

a first roller;

a cutter unit configured to cut the recording paper; and a presenter unit connected to the cutter unit and having a discharge slot from which the recording paper is discharged, wherein the recording paper on which the print head has printed enters the presenter unit through the cutter unit, and comes out from the discharge slot, and wherein the presenter unit includes:

a second roller configured to convey the recording paper;

a flapper disposed along a transportation path of the recording paper between the second roller and the cutter unit and configured to be flipped open to outside the presenter unit to expose the transportation path;

a recording paper sensor disposed between the second roller and the discharge slot; and a recording paper transport guide disposed along the transportation path of the recording paper between the second roller and the cutter unit, wherein, upon the flapper being flipped open to outside the presenter unit, the recording paper transport guide moves toward outside the presenter unit, so that the recording paper transport guide guides the recording paper to outside the presenter unit, wherein detection of the recording paper by the recording paper sensor causes the second roller to stop rotating, and causes the flapper to be flipped open to outside the presenter unit, and wherein the flapper is configured to rotate around a first rotation axis situated on a downstream side of the flapper along the transportation path, and the recording paper transport guide is configured to rotate around a second rotation axis situated on an upstream side of the flapper along the transportation path, the recording paper transport guide facing the flapper across the transport path when the flapper is closed.

2. The printer as claimed in claim 1, wherein in a state in which the second roller is stopped rotating, and the flapper is flipped open to outside the presenter unit, the first roller is configured to convey the recording paper toward the presenter unit to create a slack in the recording paper extending to outside the presenter unit through a space provided by the opened flapper, and the cutter unit is configured to cut the recording paper while the recording paper extending to outside the presenter unit has the slack.

3. The printer as claimed in claim 2, wherein the flapper is configured to be closed upon the recording paper being not detected by the recording paper sensor after the cutter unit cuts the recording paper.

4. The printer as claimed in claim 1, wherein the presenter unit includes a flapper drive motor configured to open and close the flapper.

5. The printer as claimed in claim 1, wherein the flapper being flipped open and the recording paper transport guide being moved cause the recording paper to have a slack extending to outside the presenter unit through a space provided by the opened flapper.

* * * * *